United States Patent [19]

Lee, Jr. et al.

[11] Patent Number: 4,669,278

[45] Date of Patent: Jun. 2, 1987

[54] FREEZER SYSTEM

[75] Inventors: Harry W. Lee, Jr., Chesterfield County; Horst F. W. Arfert, Midlothian, both of Va.

[73] Assignee: Reynolds Metals Company, Richmond, Va.

[21] Appl. No.: 859,385

[22] Filed: May 5, 1986

[51] Int. Cl.[4] ..... F25D 25/04

[52] U.S. Cl. ..... 62/380; 62/266; 62/441

[58] Field of Search ..... 62/63, 65, 266, 345, 62/378, 380, 381, 441, 326

[56] References Cited

U.S. PATENT DOCUMENTS

| | | | |
|---|---|---|---|
| Re. 29,477 | 11/1977 | Wight | 62/266 |
| 2,187,470 | 1/1940 | Collins | 62/140 |
| 2,259,803 | 10/1941 | Cumming | 62/102 |
| 2,588,339 | 2/1952 | Anderegg | 183/4.7 |
| 3,201,951 | 8/1965 | Robinson | 62/272 |
| 3,533,245 | 10/1970 | Komberec et al. | 62/266 |
| 4,164,129 | 8/1979 | Stueber | 62/380 X |

*Primary Examiner*—Henry A. Bennet

*Attorney, Agent, or Firm*—Alan T. McDonald

[57] ABSTRACT

A freezer system for food products, such as frozen confectioneries and the like, is discosed. Fresh air is supplied to the main chamber of the freezer through an ante room where moisture within the entry air is removed. The products are carried on a conveyor mechanism which does not pass through the ante room, providing positive air pressure within the freezer system at the entry and exit points of the conveyor, reducing substantially or eliminating entry of warm air at these points.

9 Claims, 3 Drawing Figures

FREEZER SYSTEM

BACKGROUND OF THE INVENTION

Numerous food products, and especially confectioneries, such as ice cream novelties and the like, are formed in a semi-fluid state and must be completely frozen prior to packaging and shipment. Freezing systems for such products include a conveying mechanism for the product having entry and exit positions, with the product normally being formed along the entry portion of the conveyor and removed at the exit portion of the conveyor. The main portion of the conveyor is located within a freezer box which is maintained at a sub-freezing temperature for the product.

Numerous cooling mechanisms may be employed for maintaining the temperature within the freezer box. One such mechanism involves the positioning of refrigeration coils along one upper side portion of the freezer box and positioning a plurality of fans on the opposite upper side portion of the freezer box, creating air flow generally perpendicular to the direction of travel of the conveying system through the freezer box.

A common problem with freezer systems is frost buildup. As frost builds on the cooling coils and other parts of the system, the freezer becomes less efficient, requiring down time for defrosting.

A system for reducing frosting of freezer boxes is disclosed in U.S. Pat. No. 3,857,252, the disclosure of which is hereby incorporated by reference. In this patent, the freezer box is divided into a large main chamber and a small chamber by a bulk head, or wall, separating the two portions of the box. The conveyor system passes through this small chamber through openings in the outer wall of the freezer box and the bulk head wall. According to the patent, the warm air which is drawn into the freezer box with the product at the entry portion of the conveyor will be dehydrated or defrosted within this small chamber, producing a snow-like effect within the small chamber, but leaving the main chamber basically frost-free.

Although this system is an improvement over prior freezer systems, there remains the possibility of warm air, or at least frost from warm air escaping the small chamber carried by the entry conveyor, entering the main chamber. This is due to the fact that by necessity there is a negative pressure at the opening of the freezer box where the conveyor enters the freezer box and the ability of the conveyor to thereby draw warm air along itself.

It is thus the primary objective of the present invention to isolate the conveying portion of the freezer system from the defrosting portion of the freezer system, providing a freezer system with improved efficiency.

BRIEF DESCRIPTION OF THE DRAWINGS

The freezer system of the present invention will be more fully described with reference to the drawings in which.

DETAILED DESCRIPTION OF THE PREFERRED EMBODIMENT

Figure 1:
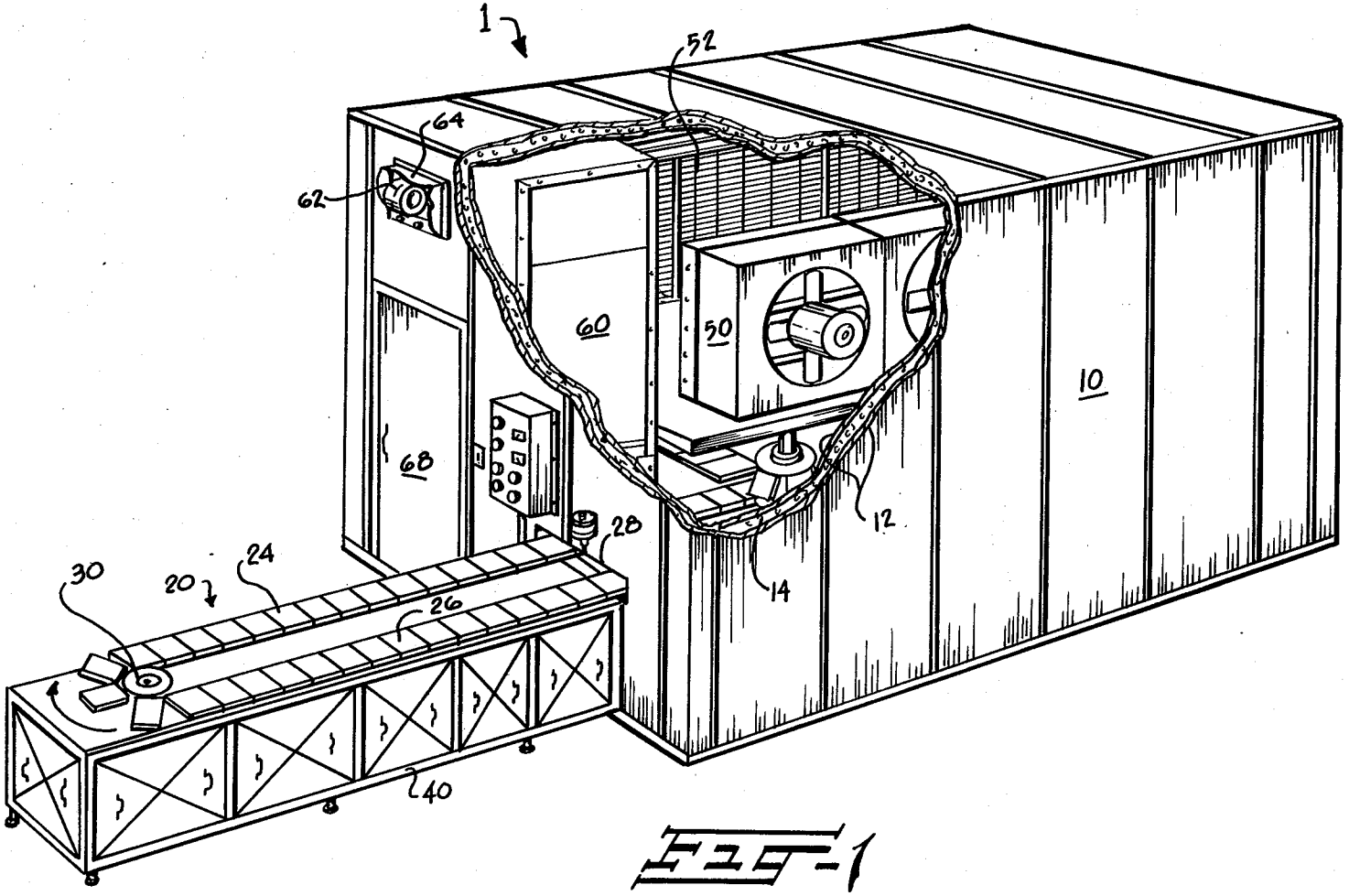
FIG. 1 is a perspective view of the freezer system of the present invention, with a portion of the main freezer box removed.
Figure 2:
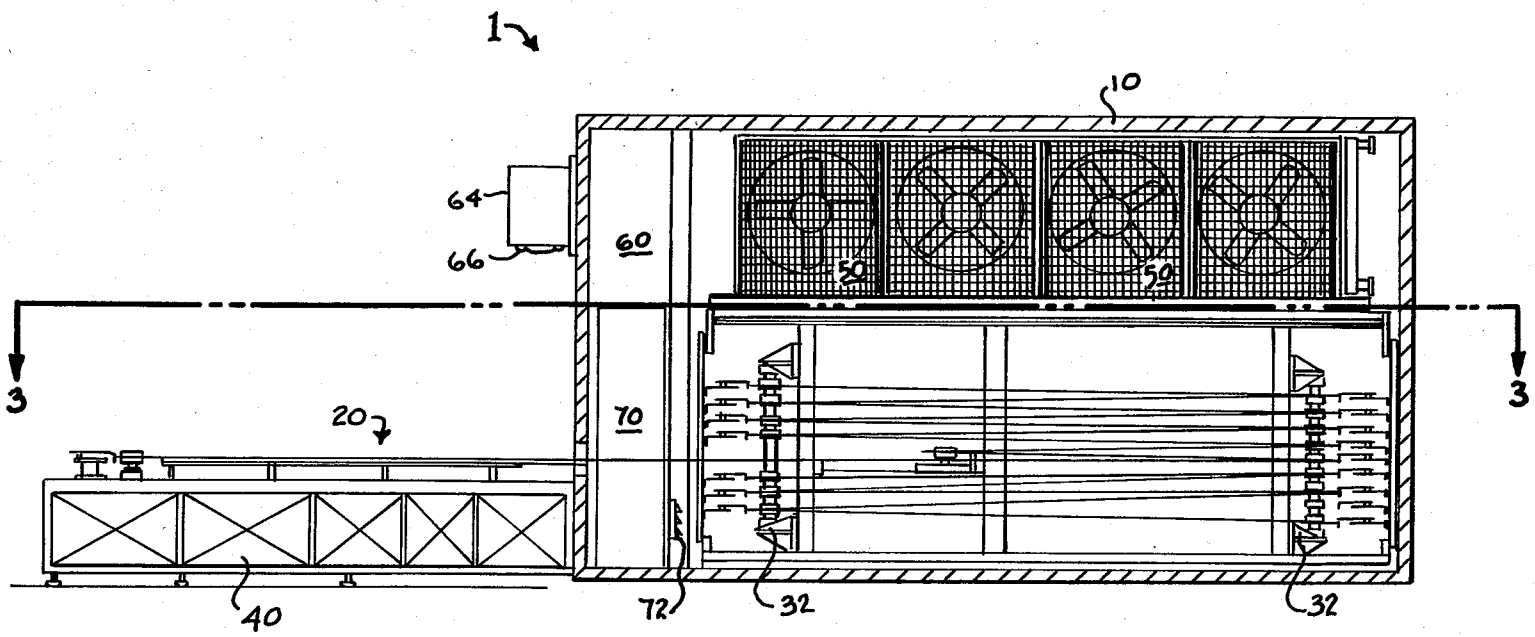
FIG. 2 is a side elevational view of the freezer system of the present invention with the front wall thereof removed.
Figure 3:
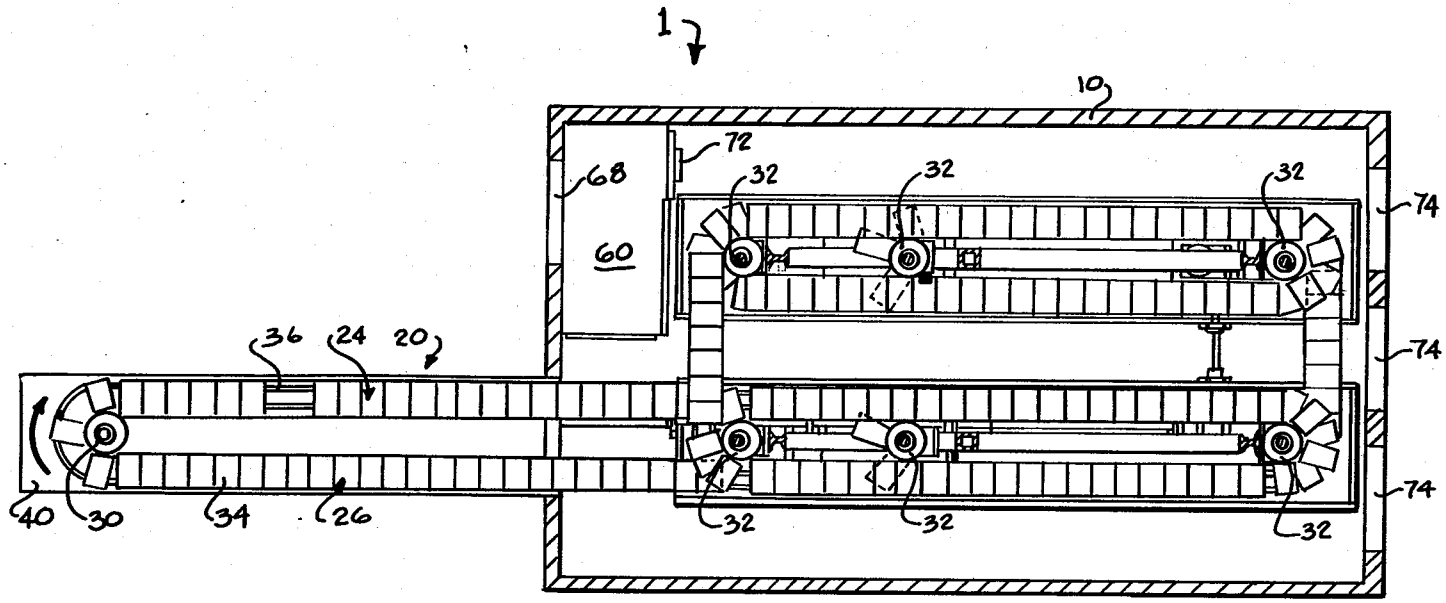
FIG. 3 is a cross-sectional view taken along line 3—3 of FIG. 2.

Turning now to the FIGURES, and especially FIG. 1, the system 1 of the present invention is illustrated. The freezer system 1 includes a main freezer box 10. This freezer box 10 is formed from a pair of metal skins 12 and an insulating .layer 14 therebetween, such as a rigid foam. A conveyor system, generally illustrated as 20, includes an entry portion 24 and an exit portion 26 which pass through opening 28 in main freezer box 10. The conveyor system also includes a driven sprocket 30 and a plurality of sprockets 32 within freezer box 10 forming basically a double spiral path within freezer box 10 for conveyor 20. Individual plates 34 ride along rails 36. This basic conveying layout is described in U.S. Pat. No. 3,857,252, and need not be described further.

The entry and exit portions 24 and 26 of conveyor 20 are supported by table 40. Typically, such confectionery forming equipment as extruders, coaters, stick inserters, rake-offs and the like are located above the conveyor 20 along table 40 so that a completed confection enters freezer box 10 and is removed from conveyor 20 upon exit from freezer box 10. This is typical of the art and need not be further described.

Within freezer box 10 are a plurality of fans 50 and cooling coils 52. The fans 50 circulate air in a direction generally perpendicular to that of the conveyor 20 within freezer box 10.

Within freezer box 10 is an ante room 60. Ante room 60 receives warm air from outside freezer box 10 through a fan 62 located within an enclosure 64 having louver 66 at the bottom thereof. Fan 62 may be a squirrel cage fan or similar fan. As air enters ante room 60, it is cooled and the humidity is removed therefrom, falling as frost or snow to the bottom of ante room 60. Doors 68 on the outside of freezer box 10 and 70 within freezer box 10 are provided to allow access to ante room 60 for snow removal when necessary.

The cooled dry air exits ante room 60 through louver 72, which is located at or near the bottom of ante room 60, thus providing essentially frost-free air within main freezer box 10. Further, as neither the entry portion 24 nor the exit portion 26 of conveyor 24 pass through ante room 60, and since there is a positive net pressure at opening 28 forcing cool air out of freezer box 10, the chances for warm air and frost entering with conveyor 20 are greatly reduced.

Besides entry to ante room 60 through door 68, entry to the main free freezer box 10 is provided through doors 74 at the rear thereof.

It is clear, therefore, that when employing the freezer system of the present invention, a positive source of fresh air is supplied to the freezer box, a positive exit of air from the freezer box is maintained and the likelihood of frost entering the main freezer box 10 is substantially reduced by isolating the ante room-frost removal portion of the freezer system from the conveying mechanism.

From the foregoing, it is clear that the present invention provides an improved freezer system with reduced maintenance for frost-related problems.

While the invention has been described with reference to certain specific embodiments thereof, it is not intended to be so limited thereby, except as set forth in the accompanying claims.

We claim:

1. In a freezing apparatus comprising a main chamber, a conveying means for transporting items into, through and out of said main chamber, and means within said main chamber for cooling said main chamber, the improvement comprising an ante room adjacent said main chamber, means for providing outside air to said ante room, said outside air being dehumidified within said ante room, and means for supplying dehumidified air from said ante room to said main chamber, and wherein said conveying means does not pass through said ante room.

2. The apparatus of claim 1 wherein said means for transporting comprises an endless conveyor.

3. The apparatus of claim 1 wherein said means for cooling comprises cooling coils and fans for circulating said air within said main chamber.

4. The apparatus of claim 1 wherein said means for providing outside air comprises a fan.

5. The apparatus of claim 4 wherein said fan is a squirrel cage fan.

6. The apparatus of claim 1 wherein said means for supplying dehumidified air from said ante room comprises a louver positioned at or near the bottom of a wall of said ante room adjacent said main chamber.

7. The apparatus of claim 1 wherein said items are food items.

8. The apparatus of claim 7 wherein said items are ice cream products.

9. The apparatus of claim 1 wherein there is a positive air pressure within said main chamber at an entry point and an exist point of said conveying means to thereby prohibit entry of outside air at said entry and exit points.

* * * * *